United States Patent [19]

Arzoumanian

[11] 4,231,294

[45] Nov. 4, 1980

[54] TOY TUBE TRAIN

[76] Inventor: Philippe Arzoumanian, 160 Eaton St., Providence, R.I. 02908

[21] Appl. No.: 41,009

[22] Filed: May 21, 1979

[51] Int. Cl.[3] ..... B61B 13/10

[52] U.S. Cl. ..... 104/138 R; 238/10 E; 104/242

[58] Field of Search ..... 46/1 K, 12, 254–261, 46/202, 216; 104/138 R, 147 A, 147 R, 148 R, 242; 238/10 R, 10 A, 10 E, 11

[56] References Cited

U.S. PATENT DOCUMENTS

| | | | |
|---|---|---|---|
| 678,312 | 7/1901 | Gilmer | 104/138 R |
| 1,482,641 | 2/1924 | Fergusson et al. | 238/10 E |
| 1,865,277 | 6/1932 | Rosenthal | 238/10 E |
| 2,876,952 | 3/1959 | Washabaugh | 238/10 R |
| 3,069,805 | 12/1962 | Burrows | 46/43 X |
| 3,343,793 | 9/1967 | Waser | 238/10 |
| 3,630,153 | 12/1971 | Gulmarin | 104/138 |
| 3,796,164 | 3/1974 | Nogi et al. | 104/138 R |

FOREIGN PATENT DOCUMENTS

| | | | |
|---|---|---|---|
| 1813995 | 12/1969 | Fed. Rep. of Germany | 104/138 R |

OTHER PUBLICATIONS

Ives Train Catalog, c. 1934, p. 35.

*Primary Examiner*—F. Barry Shay
*Attorney, Agent, or Firm*—Max Schwartz

[57] ABSTRACT

A toy train in which each track length or section is mounted in a base having a spaced longitudinal slot parallel with the tracks and outside of the tracks. In addition to the conventional rails, and lying between them, a pair of spaced parallel rails are mounted for carrying the electric current to the train. A transparent curved cover is arched over the tracks with the edges of the cover entering the slots in the base. When the track lengths are joined at the ends, a connecting strip also joins the contiguous edges of the transparent cover to form a continuous enclosed transparent tube. The train is generally annular to fit the tube. Besides the conventional flanged wheels for riding the rails, the train is also provided with a pair of grooved wheels adapted to engage the electrical rails. This not only supplies the electrical current to the train, but also serves to hold the train on the tracks and prevent derailment at high speeds especially around the curves. The tubular system may have an open section for a station and the sections may be raised over obstacles. The sections may also be curved to provide a sinuous track. On curved sections, the rails are banked to minimize derailment.

10 Claims, 11 Drawing Figures

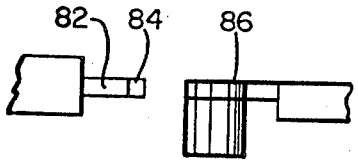
FIG. 5B
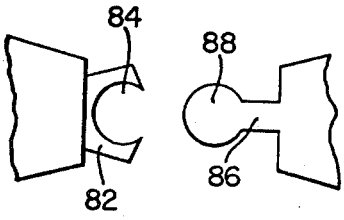
FIG. 5A
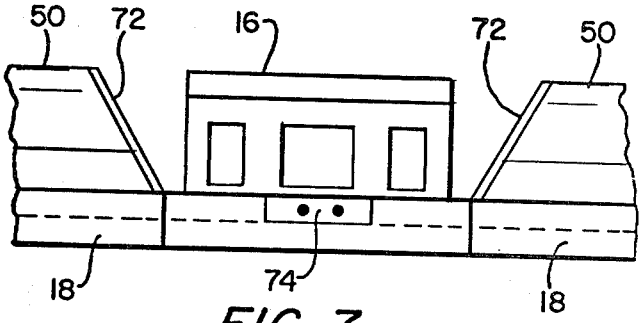
FIG. 7
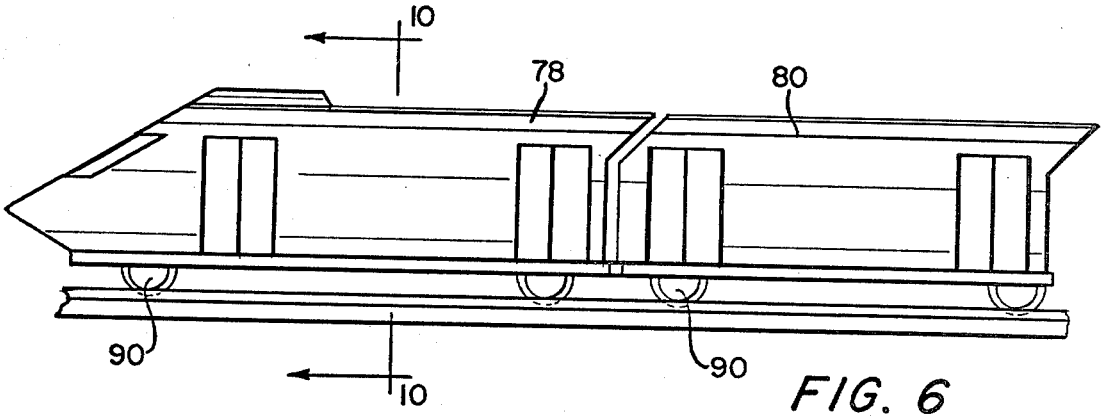
FIG. 6
FIG. 8
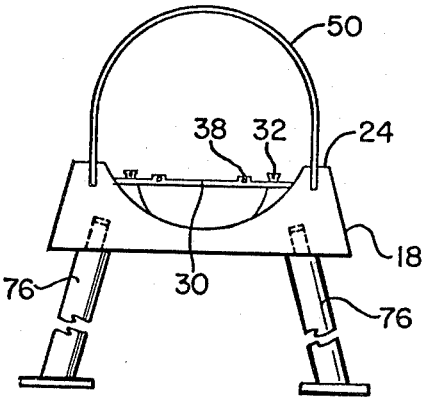
FIG. 10
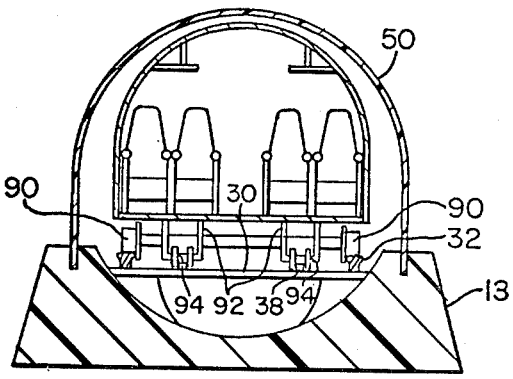

TOY TUBE TRAIN

BACKGROUND OF THE INVENTION

Trains make very popular toys for children. They like to see the trains move at varying speeds and are particularly interested in high speed operations. However, the standard toy train, whether small or large, will derail or jump the tracks on even small curves if driven at high speeds. Attempts have been made to run individual cars through plastic tubes. However, the flavor of the train running on rails is lost in such a construction and is therefore not as popular with the children.

SUMMARY OF THE INVENTION

The present invention is designed to provide a toy train including an electric locomotive and cars running on rails and capable of high speeds without derailment. Each track section is mounted on a base and covered with an arcuate, transparent plastic member having its edges nesting in grooves on the base on each side of the tracks. This forms an enclosed tubular path through which the train can travel at high speeds. On curves, the base is banked to provide a banked track to keep the train on the rails. In addition, a pair of electrical contact rails are mounted between the track rails. The engine and cars are provided with grooved wheels having spaced flanges which surround the electrical rails. This makes the electrical contact but also serves to prevent side slip or sway and thus prevents or assists in preventing derailment at high speed.

DESCRIPTION OF THE DRAWINGS

In the drawings:

FIGS. 5A and 5B are side elevation and top plan views of the train car couplings;

FIG. 6 is a side elevation of a train showing an engine and one car;

FIG. 7 is a side elevation of the station opening in the tubular track sections;

FIG. 8 is an end view of one of the track sections showing the leg mounting for raising it over obstacles;

FIG. 10 is a section taken on line 10—10 on FIG. 6.

DESCRIPTION OF THE INVENTION

Figure 2:
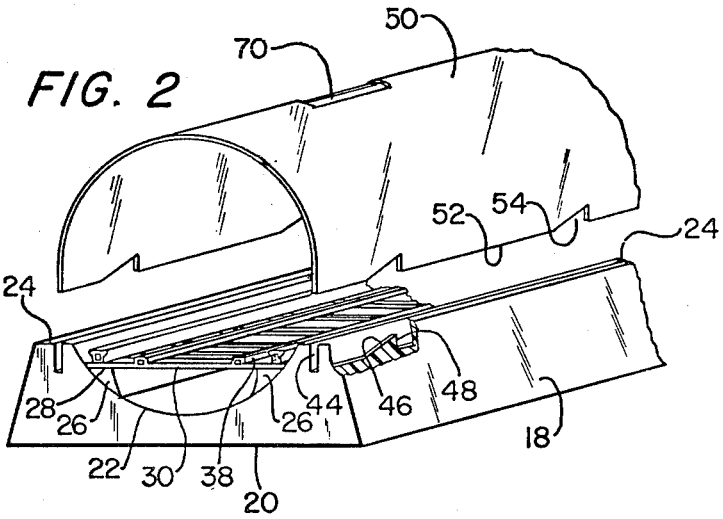
FIG. 2 is a perspective view showing one of the track sections and transparent cover therefore.

Referring more in detail to the drawings, the track layout 10 is in the form of a figure eight for illustrative purposes only. Other configurations can readily be used. It comprises a plurality of track sections 12 joined at their ends at 14. An open section is provided for locating a station 16. Now, referring to FIG. 2, each section 12 comprises a base 18 which may be of a plastic material and having a flat bottom 20 and an arcuate downwardly curved upper surface 22, terminating at each side edge with a raised flat portion 24. The downwardly curved arcuate surface 22 is provided on each side with an integral triangular supporting strip 26 extending longitudinally of the base 18. The strips 26 have flat upper surfaces 28. A plurality of spaced, dielectric, transverse, plastic strips 30 extend across the flat surfaces 28 to form spaced supporting ties. The strips 30 may be integrally joined to the surfaces 28.

Figure 4:
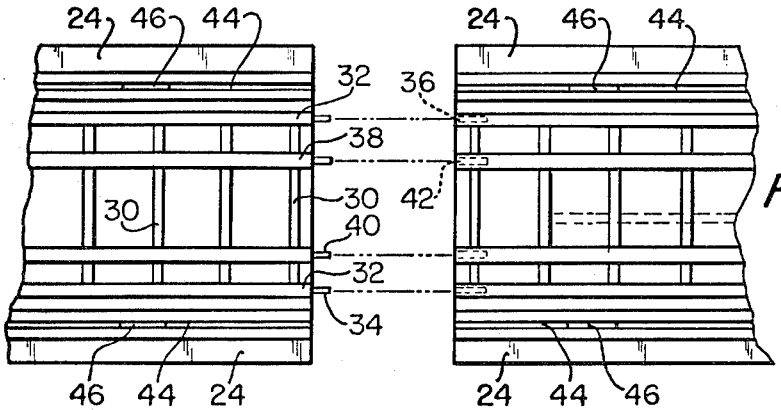
FIG. 4 is a top plan view showing the ends of adjacent sections prior to assembly.

Mounted longitudinally along the ties 30 are spaced parallel track rails 32 of conventional design, At one end of each section, the rails 32 are provided with pins 34, see FIG. 4. At the opposite end, the rails 32 are provided with openings 36 adapted to frictionally receive the pins 34 when the sections are joined end to end. Also, in spaced parallel relation, a pair of electrical contact rails 38 are positioned between the track rails 32. The contact rails 38 are also provided at one end with pins 40 and at the opposite end with openings 42 adapted to receive the pins 40.

Each section 18 is provided longitudinally along the flat surfaces 24 with grooves or slots 44. Each slot 44 has a plurality of spaced triangular stop members 46 extending upwardly into the slot and providing a vertical shoulder 48. I now provide each section with a transparent plastic cover member 50, arcuate in section with the bottom edges 52 adapted to enter the slots or grooves 44. Each edge 52 is provided with spaced triangular cut out portions 54, adapted to fit over the stop members 46 in the grooves 44 to accurately position the covers 50 in the grooves. The covers 50 are adapted to fit frictionally tightly in the grooves.

Figure 1:
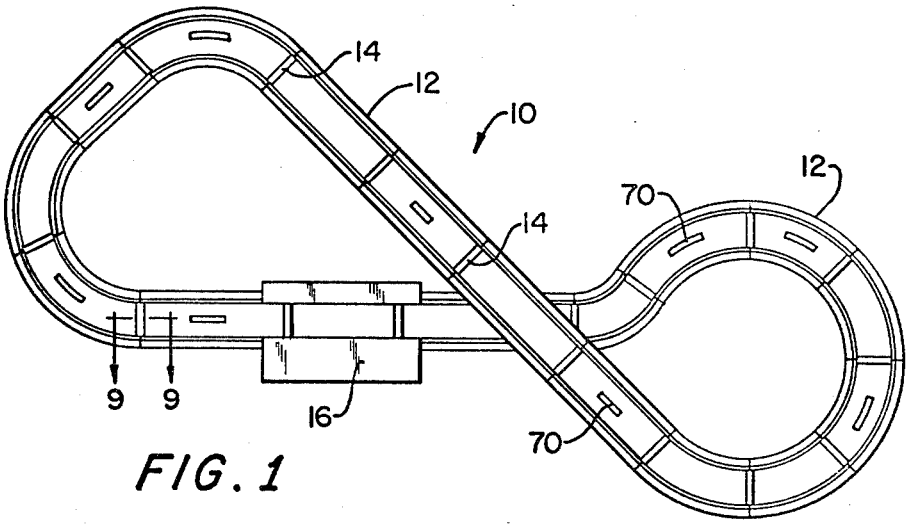
FIG. 1 is a top plan view of a set of toy trains embodying my present invention.
Figure 9:
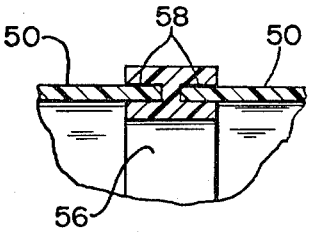
FIG. 9 is an enlarged section taken on line 9—9 on FIG. 1.

When the adjoining sections 18 are connected end to end by pushing the pins 34 and 40 into their respective openings 36 and 42, the adjacent edges of the members 50 are also joined, see FIGS. 1 and 9. A thick plastic strip 56 is provided with opposed edge to edge grooves 58 adapted to receive the adjacent edges of the members 50 to hold them together in the position shown in FIG. 1. To accommodate the strips 56, the members 50 are slightly shorter than the length of the sections 18.

Figure 3:
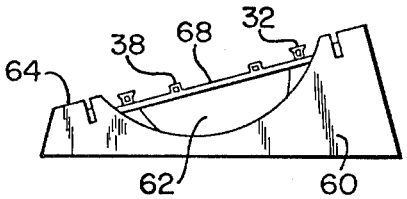
FIG. 3 is an end view of one of the banked sections on a curve.

In forming a loop or the figure eight 10 in FIG. 1, curved sections are provided. In view of the high speed, the curves should be banked as shown in FIG. 3. The base portion 60 is provided with the arcuate cut out section 62 which is at an angle to the horizontal so that the flat sections 64 is lower than the opposite flat section 66. The ties 68 are also mounted at an angle to hold the rails 32 and electrical contact rails 38 at an angle. These sections should taper to the horizontal at their ends when they are joined to a level section. Air vents 70 are provided in some of the covers 50 to allow for the high speed movement of the train and cut down the air resistance.

At one point along the track layout a station 16 is positioned. Viewing FIG. 7, the station 16 takes the place of one of the sections 18. The adjoining sections should have their covers 50 cut back at 72 on each end of the station for clearance. The station 16 has a track section with the electrical connections (not shown). An outlet 74 is provided on the side for plugging in a line to a conventional transformer (not shown) for operating and controlling the train. In forming the figure eight shown in FIG. 1, it is necessary to raise some sections over others. As shown in FIG. 8, legs or posts 76 are threaded into the bottom of the bases 18 at an outward angle to more steadily withstand the high speed operation.

The preferred train is illustrated in FIGS. 6 and 10. The locomotive 78 and car or cars 80 are streamlined and arcuate to generally conform to the shape of the section cover members 50. The linkage between cars can be made in any conventional manner, one way is illustrated in FIGS. 5A and 5B. One end of each car is provided with a flat extension 82 having an opening 84 with a gap at the front end. At the other end, each car is provided with an extension 86 having a depending annular member 88 which can be pushed or snapped through the gap and into the opening 84. At the bottom, each car is provided with conventional flanged wheels and axles 90 for riding on the rails 32. In addition, the cars are provided with spaced supports 92 holding wheels 94 which have double flanges and central grooves. The wheels 94 are adapted to ride on and contact the electrical contact rails 38. In addition, the flanges surround the rails 38 to hold the train against side sway or derailment at high speeds.

The operation is obvious. The train will run in the tube formed by the transparent cover members 50. The enclosed tube, banked tracks and flanged wheels will serve to keep the train on the rails even at high speeds. Actually, the train can be operated on the rails at much higher speeds than with other conventional toy trains.

The construction is simple and comparatively easy to manufacture and assemble. It is not too complex for a young child to assemble and operate. Other advantages of the present invention will be readily apparent to a person skilled in the art.

I claim:

1. A high speed toy train comprising a plurality of detachably connectible track sections each having an elongated base, a pair of spaced parallel track rails mounted on said base, means mounted on said base between said track rails for supplying electrical current to a toy train on said rails, means to confine the train and prevent derailment at high speeds comprising a transparent cover for said base, coacting means on said base and cover for mounting said cover to said base, and a toy train for operating on said rails, said train having means for contacting said electrical supply means between said track rails.

2. A toy train as in claim 1, wherein said electrical supply means comprises a pair of spaced parallel rails mounted between said track rails, said contacting means comprising a pair of spaced wheels adapted to electrically contact said electrical supply rails.

3. A toy train as in claim 1, wherein said electrical supply means engages said contacting means to hold said train on said track rails against derailment.

4. A toy train as in claim 2, wherein said spaced wheels engage said spaced rails to hold said train on said track rails against derailment.

5. A toy train as in claim 4, wherein said spaced wheels are provided with spaced flanges forming a groove therebetween, said groove and flanges engaging said electrical supply rails for electrical contact and for holding said train on said track rails.

6. A toy train as in claim 1, wherein the track rails and said electrical supply means of each section are provided with extending pins at one end and openings at the opposite end adapted to frictionally receive the pins of the adjacent section.

7. A toy train as in claim 6, wherein said transparent covers are arcuate in shape, an arcuate strip with opposed grooves between the covers of adjoining sections, the edges of said covers of adjoining sections entering said strip grooves when said sections are joined to form a continous track layout.

8. A toy train as in claim 1, wherein a track section is provided having a railroad station and no cover, said station section having electrical connections to said electrical supply means, and an electrical outlet on said station for receiving the cord connection to a toy train control transformer.

9. A toy train as in claim 1, wherein the sections on the curves are provided with curved bases, the rail tracks on said curved bases being angularly banked to prevent said train from derailment on said curves at high speed.

10. A toy train as in claim 1, wherein said bases may be joined to form a continuous track loop, and supporting legs threaded into the bottom of those bases which must be raised to cross over the unraised bases to form a complex track rail assembly.

* * * * *